United States Patent [19]

Nishikawa et al.

[11] 4,111,156

[45] Sep. 5, 1978

[54] DEVICES FOR DEVELOPING AN ELECTROSTATIC CHARGE IMAGE ON A RECORD SHEET BY A DEVELOPER SOLUTION

[75] Inventors: Masaji Nishikawa, Hachioji; Yoshiro Suzuki, Tama; Tadahiro Yasuda, Fuchu, all of Japan

[73] Assignee: Olympus Optical Co., Ltd., Tokyo, Japan

[21] Appl. No.: 809,045

[22] Filed: Jun. 22, 1977

Related U.S. Application Data

[63] Continuation of Ser. No. 637,768, Dec. 4, 1975, abandoned.

[30] Foreign Application Priority Data

Dec. 9, 1974 [JP] Japan ..... 49-140532

[51] Int. Cl.[2] ..... G03G 15/10; G03G 15/06

[52] U.S. Cl. ..... 118/662; 118/651; 355/10; 427/15

[58] Field of Search ..... 118/661, 662, 659, 652, 118/647, 648, 650, 651; 427/15-17; 355/10

[56] References Cited

U.S. PATENT DOCUMENTS

| | | | |
|---|---|---|---|
| 3,359,945 | 12/1967 | Hastings et al. | 118/662 |
| 3,769,896 | 11/1973 | Samuels et al. | 355/10 X |
| 3,799,791 | 3/1974 | Kolibas | 427/17 |
| 3,815,545 | 6/1974 | Sato et al. | 118/648 |
| 3,817,212 | 6/1974 | Fukushima et al. | 118/648 |
| 3,820,891 | 6/1974 | Kurakawa et al. | 118/647 X |
| 3,822,670 | 7/1974 | Sato et al. | 118/648 |
| 3,862,619 | 1/1975 | Fukushima et al. | 118/648 |
| 3,913,524 | 10/1975 | Fukushima et al. | 118/648 |
| 4,014,608 | 3/1977 | Terashima | 355/10 X |

FOREIGN PATENT DOCUMENTS

| | | | |
|---|---|---|---|
| 1,927,332 | 12/1969 | Fed. Rep. of Germany | 427/15 |
| 1,522,555 | 9/1969 | Fed. Rep. of Germany | 118/662 |

*Primary Examiner*—James Kee Chi

*Attorney, Agent, or Firm*—Haseltine, Lake & Waters

[57] ABSTRACT

A device for developing a latent image produced on a record sheet by an effect of electrostatic charge by charged particles dispersed in a developer solution is disclosed. The device comprises a tank containing the developer solution and at least one pair of opposed rollers immersed in said developer solution at an intermediate region of said tank, said opposed rollers being passed by the record sheet therebetween and arranged closely adjacent to the record sheet.

3 Claims, 4 Drawing Figures

DEVICES FOR DEVELOPING AN ELECTROSTATIC CHARGE IMAGE ON A RECORD SHEET BY A DEVELOPER SOLUTION

This is a continuation of application Ser. No. 637,768 filed Dec. 4, 1975, now abandoned.

This invention relates to a device for developing an electrostatic charge image by a developer solution, which can develope a latent image produced on a record sheet by an effect of electrostatic charge by charged particles dispersed in the developer solution.

Such kind of devices for developing the electrostatic charge image by the developer solution have been well known and various types thereof have widely been used in phototelegraphy such as facsimile and the like. These developing devices are made different in construction for the purpose of satisfying conditions required such, for example, as a developing speed, picture quality, shape of record sheet and the like.

In the case of designing and manufacturing developing devices, many difficult problems have been encountered, that is, a sufficient development can not be obtained within a short time, there remains an edge effect, a record sheet could not be fed in a smooth manner and the like. In the developing devices heretofore proposed, many attempts have been made in order to eliminate the above mentioned problems. These attempts are broadly divided into two measures. One of these measures consists in arrangement of developing electrodes, while the other measure consists in how to feed a developer solution.

The use of the former measure is restricted by a limited space through which the record sheet can pass. That is, it is impossible to arrange the developing electrode at a position where the distance between the record sheet and the developing electrode is at most 1 to 2 mm and hence a sufficient effect of the developing electrode could not be attained.

The latter measure is comprised of methods of agitating the developer solution or of forcedly flowing the developer solution on the record sheet or of injecting the developer solution as a jet stream upon the record sheet. The use of these methods, however, results in an unsatisfactory feed of the developer solution.

As well known in the art, the shorter the distance between the developing electrode and the record sheet to be developed, the more significant will be the effect of the developing electrode. If the distance between the developing electrode and the record sheet to be developed is on the order of 0.1 to 0.2 cm, there occurs an edge effect, i.e., the concentration of the picture image apart from the edge of the charge image by at least several mm becomes distinctly degraded. As a result, it is not only impossible to make visible a picture image having a good contrast, but also impossible to produce a sufficiently high electric field orientated from the charged image to the developing electrode. As a result, a required high speed development could not be attained. In addition, even though the feed of the developer solution is taken into consideration, the movement of toner particles dispersed in the developer solution and contributing to the development is limited to a range on the order of 20 $\mu$ from the charged image surface. The prior art techniques have the disadvantage that the effect of changing the developer solution in the range adjacent to the charged image surface is extremely small.

An object of the invention is to provide a device for developing an electrostatic charge image by a developer solution, which can obviate the above mentioned disadvantages and can provide a developed picture having a sufficiently high concentration and contrast without having any edge effect and visible grain in a high speed.

A feature of the invention is the provision of a device for developing an electrostatic charge image by a developer solution, comprising a tank containing a developer solution containing charged particles dispersed therein, a record sheet bearing a latent image produced by an effect of electrostatic charge, said record sheet being fed from one end of said tank into said developer solution and leaving said tank from another end thereof, and at least one pair of opposed rollers immersed in that part of said developer solution which is located at an intermediate region of said tank, said opposed rollers being passed therebetween by said record sheet and arranged closely adjacent to said record sheet.

In accordance with the invention, the above mentioned opposed rollers are arranged under such condition that these rollers are passed therebetween by the record sheet and arranged in contact with or closely adjacent to the record sheet. As a result, these opposed rollers are driven at a speed which is equal to the moving speed of the record sheet to be developed. If the rollers are formed of metals, electric conductive rubber and the like, these rollers act as developing electrodes in a remarkably efficient manner. In addition, the rollers are arranged in an intermediate region of the tank so that these rollers serve to effect forced removal of a solution layer which has been subjected to the developing action and hence contains a small amount of toner and adhered to that portion of the record sheet which is adjacent to the charged image. As a result, the charged image surface of the record sheet is subjected to the action of the fresh developer solution after the record sheet has passed through the rollers. If the fresh developer solution is caused to be acted upon the charged image surface only, the rollers may be formed of electric insulating material. In addition, as above mentioned, the rollers are driven at a speed which is equal to the moving speed of the record sheet under such condition that these rollers are urged against or made closely adjacent to the record sheet. As a result, the rollers serve also as rollers for feeding the record sheet, so that there is no risk of the developing device being clogged by the record sheet.

The invention will now be described in greater detail with reference to the accompanying drawings, wherein.

Figure 1:
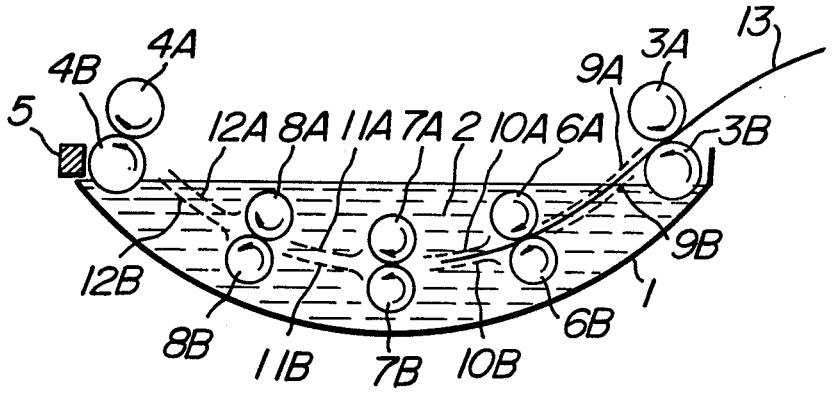
FIG. 1 is a diagrammatic view showing one embodiment of the device for developing an electrostatic charge image by a developer solution in accordance with the invention.

In FIG. 1 is shown one embodiment of a device for developing an electric charge image by a developer solution according to the invention. In the present embodiment, in a tank 1 is contained a developer solution 2 containing charged particles dispersed therein. A sheet of record paper to be developed 13 on which is formed an electrostatic charge image is transferred from a right inlet end of the tank 1 to a left outlet end thereof. The tank 1 is provided at its inlet end with a pair of opposed rollers 3A and 3B for taking up the record sheet 13 and feeding it into the developer solution tank 1 and provided at its left outlet end with another pair of opposed rollers 4A and 4B for delivering the record sheet 13 from the tank 1 toward a conventional after treatment device and removing a surplus developer solution. At the rear of one of the opposed rollers 4B is arranged a cleaning pad 5 which serves to remove that part of the developer solution which is adhered to the roller 4B so as to make the surface thereof clean.

In the present invention, three pairs of opposed rollers 6A, 6B; 7A, 7B and 8A, 8B are arranged in succession along a moving path of the record sheet 13 and spaced apart from each other in the intermediate region of the developer solution 2 in the tank 1. In spaces formed between these opposed rollers are arranged perforated guide frames 9A, 9B; 10A, 10B; 11A, 11B and 12A, 12B, respectively. Each of these guide frames is comprised of two opposed perforated frames which permit the developer solution to freely pass therethrough. All of the rollers are caused to be rotated at a given speed in directions shown by arrows by a suitable driving mechanism. In this case, the rollers 6A, 6B; 7A, 7B and 8A, 8B are caused to be rotated at a speed which is equal to the moving speed of the record sheet 13.

Figure 2:
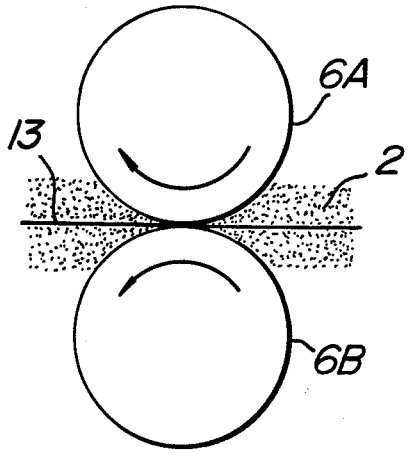
FIG. 2 is a side elevational view of a pair of opposed rollers in an enlarged scale illustrating the operation of the device shown in FIG. 1.

In FIG. 2 is shown a pair of opposed rollers 6A, 6B, record sheet 13 and developer solution 2 of the device shown in FIG. 1 in an enlarged scale. The record sheet 13 passes between the pair of opposed rollers 6A, 6B such that the record sheet 13 is made in contact with or contact under pressure with the pair of opposed rollers 6A, 6B and hence is transferred from the right inlet end to the left outlet end of the tank 1 shown in FIG. 1. As a result, even when the developer solution whose charged particles become thin in concentration is present on that part of the record sheet 13 which is located at the right side of the opposed rollers 6A, 6B, such thin developer solution is removed when the record sheet 13 passes between the opposed rollers 6A, 6B. As a result, at the left side of the opposed rollers 6A, 6B, the developer solution having a sufficiently high concentration becomes in contact again with the record sheet 13. Thus, the concentration of the recorded picture image becomes sufficiently high, thereby making it possible to effect a high speed development.

Figure 3:
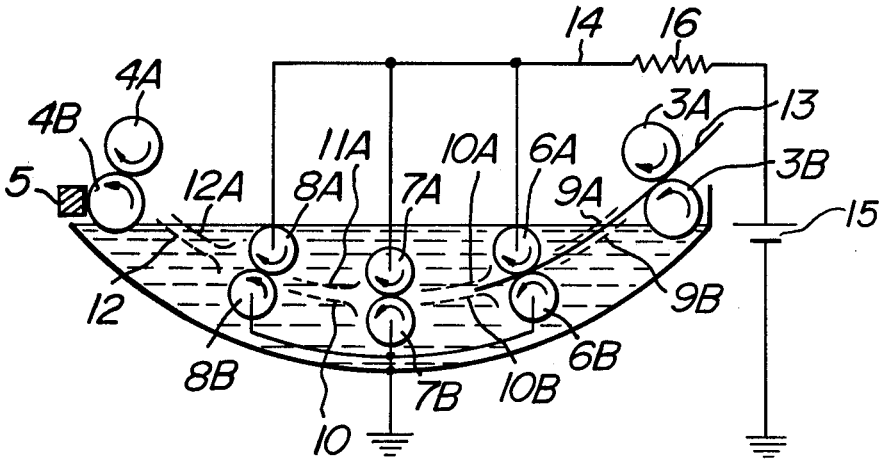
FIG. 3 is a diagrammatic view showing another embodiment of the device for developing an electrostatic charge image by a developer solution.

In FIG. 3 is shown another embodiment of the device according to the invention. In the present embodiment use is made of three pairs of opposed rollers 6A, 6B; 7A, 7B and 8A, 8B each formed of electric conductive material such, for example, as metals, electric conductive rubber and the like. These rollers play a role of developing electrodes whereby the adverse edge effect can effectively be eliminated. The upper rollers 6A, 7A, 8A are connected through a common conductor 14 and a current limiting resistor 16 to a positive electrode of a D.C. supply source 15 whose negative electrode is grounded, while the lower rollers 6B, 7B, 8B are connected through a common conductor 16 to the ground.

In the present embodiment, the rollers acting as the developing electrodes are closely adjacent to the record sheet 13, so that a highly intense electric field is produced therebetween. This electric field permits the developing electrodes to significantly improve their developing effect.

Figure 4:
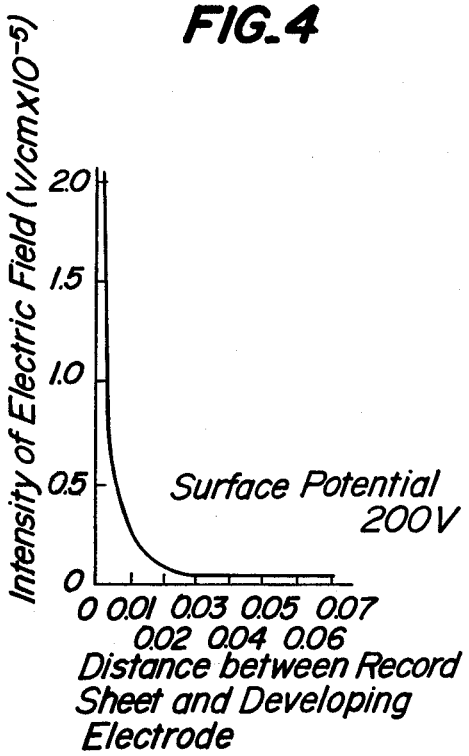
FIG. 4 is a graph illustrating the operation of the developing electrode shown in FIG. 3.

In FIG. 4 is shown a curve which illustrates a relation between a distance between the record sheet and the developing electrode taken on the abscissa and an intensity of electric field produced between the record sheet and the developing electrode taken on the ordinate with a surface potential on the record sheet of 200 V. As seen from FIG. 4, as the distance between the record sheet and the developing electrode becomes shorter the electric field produced therebetween is increased in exponential function manner. As above mentioned, this high electric field permits the developing electrodes to significantly improve their developing effect and effect the development in a high speed.

As described above, the opposed rollers are rotated and arranged in contact with or closely adjacent to the record sheet.

A mechanism for rotating the opposed rollers in contact with the record sheet may comprise gears secured to rotary shafts of the opposed rollers and threadedly engaged with each other, pulleys secured to the rotary shafts, respectively, a resilient belt engaged with the respective pulleys, and a driving means for rotating one of the rotary shafts. The mechanism can rotate the opposed rollers while urging them against the record sheet.

If the rollers act as the developing electrodes, one of the rollers in contact with the outside surface of the record sheet may be formed of a metal roller, while the other roller in contact with the inside surface of record sheet may be formed of a rubber roller. The use of the measures described provides the advantage that the opposed rollers can effectively be urged against the record sheet, and that the record sheet can be fed in a smooth and reliable manner.

In the case of connecting the opposed rollers to ground or applying a bias potential thereto, use may be made of electric conductive rubber rollers.

The guide frames may be formed of an electric conductive material and used as auxiliary developing electrodes. The use of the measures described ensures a high speed development with a small developing device.

Experimental tests have yielded the result that the developing electrode rollers can eliminate the edge effect so as to provide a picture having a sufficiently high concentration and contrast, and that the guide frame electrodes play a role of improving contrast of the dark portion of the picture without producing any grey portion thereon.

If the guide frames are used as the developing electrodes, that side of the guide frames which is opposed to the outside surface of the record sheet may be formed of an electric conductive material.

What is claimed is:

1. A device for developing an electrostatic charge image on a record sheet by a developer solution, comprising: a tank containing a developer solution with charged particles dispersed therein, said record sheet being fed from one end of said tank into said developer solution and leaving said tank from another end thereof, and at least one pair of opposed rollers immersed in that part of said developer solution which is located at an intermediate region of said tank, said opposed rollers being resiliently urged against said record sheet under pressure and rotated so as to feed said record sheet through said developer solution, said opposed rollers immersed in said developer solution being formed of electric conductive material and one of said opposed rollers is connected through a resistor to one terminal of a D.C. supply source and the other roller is connected to the other terminal of said D.C. supply source, thereby preventing said electroconductive rollers from being shortcircuited in the absence of said record sheet.

2. The device as claimed in claim 1, wherein said tank includes a plurality pairs of opposed rollers arranged in succession and spaced apart from each other in said intermediate region of said tank, a pair of take up opposed rollers arranged at the inlet end of said tank, a pair of delivering opposed rollers arranged at the outlet end of said tank, a cleaning pad arranged at the rear of one of said delivering opposed rollers, and two opposed perforated guide frames arranged between said successive rollers.

3. A device for developing an electrostatic charge image on a record sheet by a developer solution, comprising: a tank containing a developer solution with charged particles dispersed therein, said record sheet being fed from one end of said tank into said developer solution and leaving said tank from another end thereof, and at least one pair of opposed rollers immersed in that part of said developer solution which is located at an intermediate region of said tank, said opposed rollers being resiliently urged against said record sheet under pressure and rotated so as to feed said record sheet through said developer solution, a D.C. supply source, whose one terminal is connected to one of said opposed rollers and another terminal is connected through the ground to another roller, said tank including a plurality of pairs of opposed rollers arranged in succession and spaced apart from each other in said intermediate region of said tank, a pair of take up opposed rollers arranged at the inlet end of said tank, a pair of delivering opposed rollers arranged at the outlet end of said tank, a cleaning pad arranged at the rear of one of said delivering opposed rollers, and two opposed perforated guide frames arranged between said successive rollers.

* * * * *